United States Patent [19]

Derdyk

[11] Patent Number: 4,624,365

[45] Date of Patent: Nov. 25, 1986

[54] PACKAGING ARRANGEMENT FOR PLASTIC BAGS

[75] Inventor: Flávio Derdyk, São Paulo, Brazil

[73] Assignee: Plasticos Polyfilm S/A, Sao Paulo, Brazil

[21] Appl. No.: 717,242

[22] PCT Filed: Nov. 11, 1983

[86] PCT No.: PCT/BR83/00011

§ 371 Date: Jan. 22, 1985

§ 102(e) Date: Jan. 22, 1985

[87] PCT Pub. No.: WO85/00793

PCT Pub. Date: Feb. 28, 1985

[30] Foreign Application Priority Data

Aug. 3, 1983 [BR] Brazil ..... 8304169

[51] Int. Cl.[4] ..... B65D 85/62

[52] U.S. Cl. ..... 206/554; 206/494; 206/526; 383/37

[58] Field of Search ..... 206/494, 526, 554; 383/77, 37

[56] References Cited

U.S. PATENT DOCUMENTS

| | | | |
|---|---|---|---|
| 1,662,080 | 3/1928 | Silbar | 206/494 |
| 2,029,245 | 1/1936 | Lyon | 206/494 |
| 2,115,699 | 5/1938 | Boyd . | |
| 2,788,822 | 4/1957 | Parker | 206/554 |
| 3,281,056 | 10/1966 | Kugler | 206/554 |
| 3,318,444 | 5/1967 | Weicher et al. . | |
| 3,329,260 | 7/1967 | Medleycott | 206/554 |
| 3,333,690 | 8/1967 | Marsh | 206/554 |
| 3,346,104 | 10/1967 | Marsh | 206/554 |
| 3,353,661 | 11/1967 | Membrino | 206/554 |
| 3,417,864 | 12/1968 | Paxton | 206/554 |
| 3,674,135 | 7/1972 | Simon | 383/77 |
| 3,962,823 | 6/1976 | Zipperer | 47/37 |
| 4,006,823 | 2/1977 | Soto | 206/554 |
| 4,216,863 | 8/1980 | Seymour-Smith | 206/554 |
| 4,487,318 | 12/1984 | Roen | 206/554 |

FOREIGN PATENT DOCUMENTS

| | | | |
|---|---|---|---|
| 2759240 | 7/1978 | Fed. Rep. of Germany | 206/554 |
| 1209406 | 10/1970 | United Kingdom | 206/554 |

*Primary Examiner*—William Price
*Assistant Examiner*—Brenda J. Ehrhardt
*Attorney, Agent, or Firm*—Cushman, Darby & Cushman

[57] ABSTRACT

Flat open ended plastic bags having at transverse piercing adjacent their open ends to provide a tear strip. The bags are stacked with their open ends in alignment and then the stack folded end for end so that the closed ends of the bags are slightly short of the transverse tear strips. The folded bag assembly is then folded transversely and the twice folded assembly introduced, tear strips first, in the open end of a package which may be another plastic bag. The enclosing plastic bag and the tear strips therein are then secured together by a transverse welding. The open end of the enclosing bag may then closed. Preferably the enclosing bag also has transverse piercing adjacent its open end to provide another tear strip. Thus when the closed end of the bag is torn off by its tear strip, the bags in the package may be removed, one by one, by tearing them from their strips without disturbing the remaining bags in the package.

4 Claims, 14 Drawing Figures

PACKAGING ARRANGEMENT FOR PLASTIC BAGS

As it is known, one of the greatest problems of the usual plastic bags is, without doubt, the way thay are arranged in their packages, in order that the user can take them out, one by one, as needed. It really doesn't happen, because they are just folded and placed inside of a package, without any particular arrangement, in respect of their removal by the user, so that when one unit is needed, and due to the material slippering feature, it is hard to keep the remaining ones piled up. Therefore it takes a large space.

The above mentioned difficulties are totally solved with the present "CONDITIONING DISPOSITION OF PLASTIC BAGS AND ITS RESPECTIVE PACKAGE". This invention provides a manner of superposing several plastic bag units, so that their open edges remain in the same side, and preceded by a parallel pierced line. This way the bags are longitudinally and transversally folded, and after that put in a package, that is also a plastic bag. Right away, the bags are closed by means of a welding line, that is applied between the pierced line and the open edges of the bags. Thus all bag units and the enclosing package remain hold together. The enclosing package is provided in the opposed welding line of the bags with a pierced line, in order that it can be easily opened the plastic bags inside be taken out, one by one, without disassembly of the others. This manner, the user holds the pierced edge with one hand, and with the other he pulls the unit out. This unit detachs itself from the package through the pierced line, that is near to its opening, and the other unit remains unchanged. Therefore, with the present invention there is obtained a practical handling package for plastic bags, that permits one to take a bag out unit by unit, and maintain the others properly arranged in the package.

For a better understanding of the present invention, drawings are enclosed, where FIGS. 1, 2, 3, 4 and 5 are perspective views, showing the several steps to obtain the packing and closing of the plastic bags assembly;

finally FIGS. 11, 12, 13 and 14 are perspective views showing how to detach the plastic bag and respective tie strip, and how to use both of them.

Figure 1:
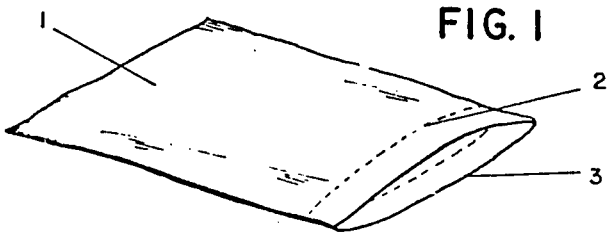
Figure 2:
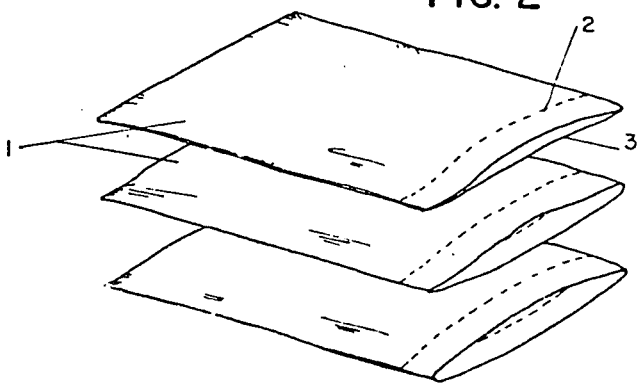
Figure 3:
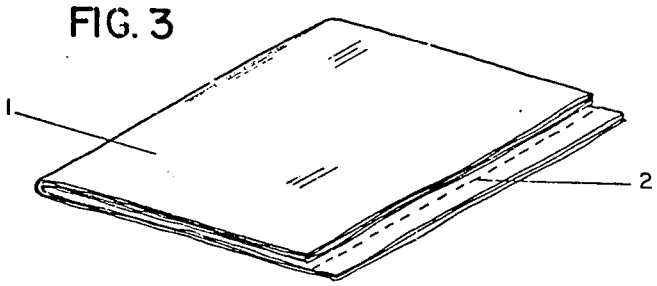
Figure 4:
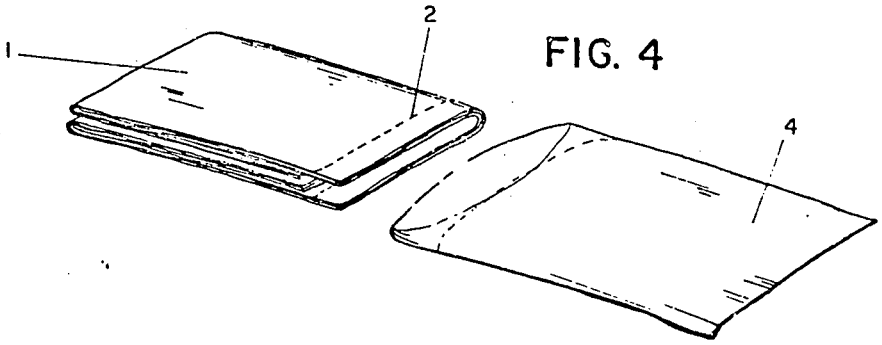

The present invention refers to a "CONDITIONING DISPOSITION OF PLASTIC BAGS AND ITS RESPECTIVE PACKAGE", of a generically type (1) in the FIG. 1, characterized by having a transverse piercing (2), to provide a tear strip close to its open end (3). After that, according to the FIG. 2, several units (1) are piled up, so that the ends (3) remain facing the same way. Right away (see FIGS. 3 and 4) the bags (1) are folded first longitudinally and then transversely, the first fold leaving the bottom of the bags short of the tear strips.

Figure 5:
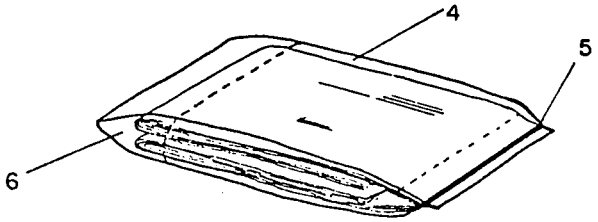
Figure 6:
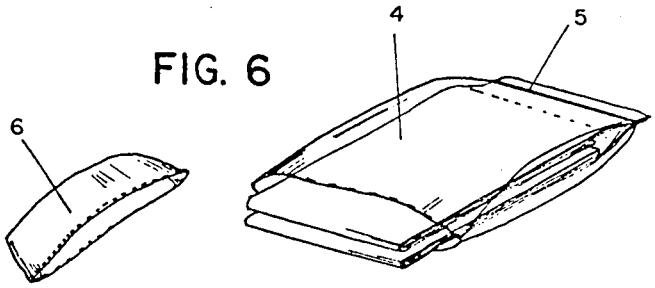
FIGS. 6 and 7 are also perspective views, showing how to take the bags unit by unit out of the plastic bags package.
Figure 7:
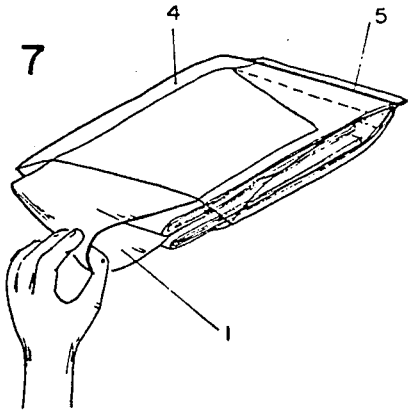

The folded bags (1) are then introduced tear strip first into a package (4), which is also a plastic bag. Then the assembly and the package (4) are fastened together (see FIG. 5), through a transverse welding (5), which is applied across the tear strips of the folded bags, keeping them interconnected, but detachable one by one. For this purpose, the package (4) has a removable part, e.g. a tear strip at its open end (6), that permits an easy opening (see FIG. 6), in order to take the unit or plastic bags (1) out, and, as it has already been mentioned (see FIG. 7), the bags can be taken out, one by one, without changing the other unit position.

Figure 8:
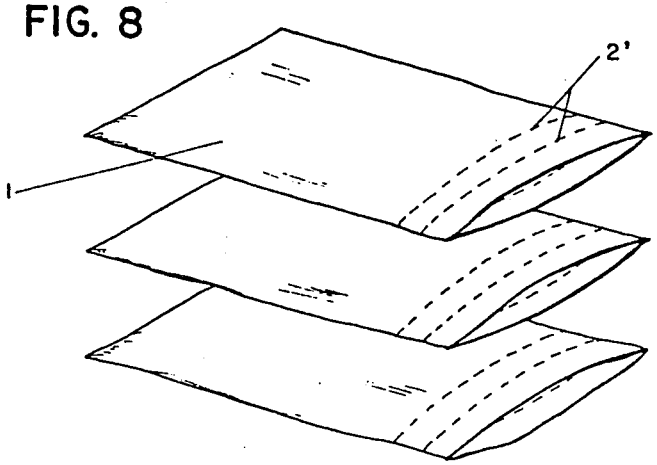
FIGS. 8, 9 and 10 are also perspective views, showing the several steps to obtain the packing and closing of a plastic bags assembly, which ends have incorporated tie strips.
Figure 9:
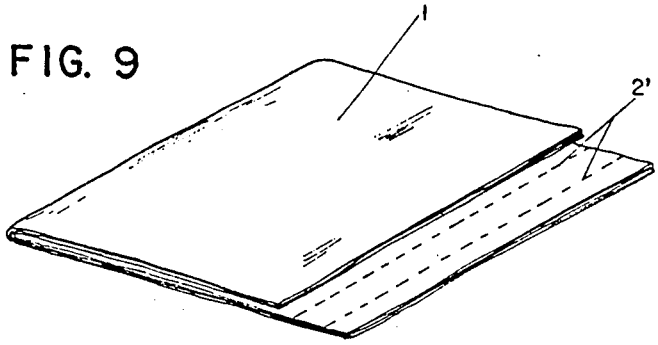
Figure 10:
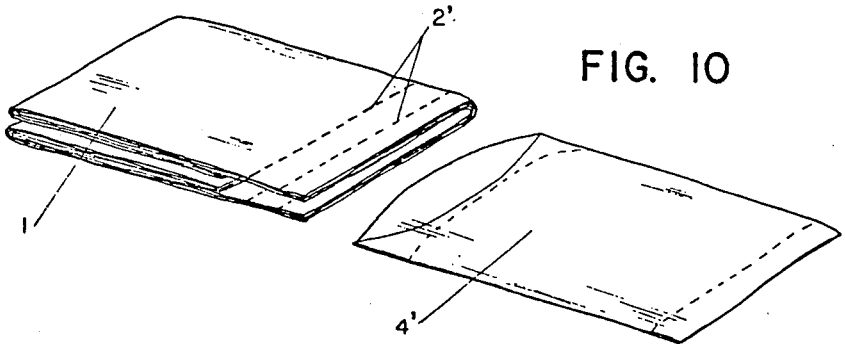
Figure 11:
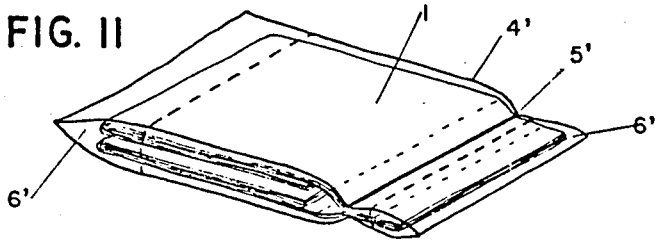
Figure 12:
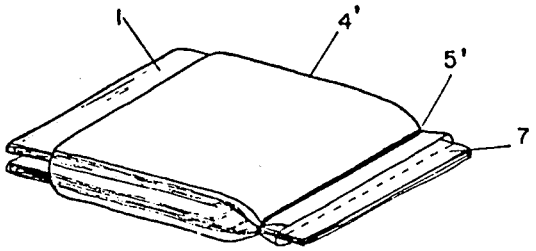
Figure 13:
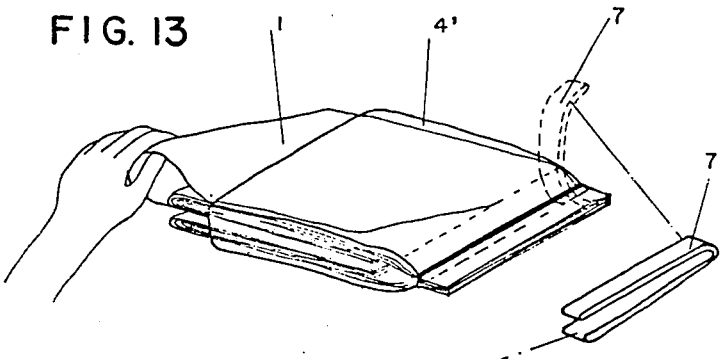

On the other hand, in accordance to the FIG. 8, the plastic bags (1) can be provided with two parallel and transversal piercing (2'), and could be equally longitudinally and transversally folded (FIGS. 9 and 10, in order to be introduced in a package (4'), that is also a plastic bag (see FIG. 11). After that the assembly is closed through a transversal welding (5'), which is applied among the piercing (2'), performing tie strip (7). The tie strip and the plastic bags (1) are easily detached through the piercing (2'). For this purpose the package (4') has also removable parts (6'), that permits the opening of the said package (4'), so that the plastic bags (1) (see FIG. 13) can be taken out, one by one, by one side, while the tie strips (7) are detached by the opposite side, and so successively, until the utilization of the last plastic bag (1).

Figure 14:
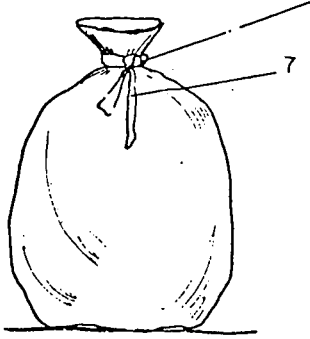

In accordance to the FIG. 14, the plastic bag (1) is easily tied by a double and resistant strip (8), which is each plastic bag (1) section.

I claim:

1. A package comprising:

a stack of open-mouth generally flat bags of sheet material having transverse tear-strips at their mouths and with said mouths being aligned, said stack being folded once longitudinally, i.e. at a transverse folding line, with said tear-strips extending beyond the bottoms of said bags, and folded once tranversely, i.e. at a longitudinal folding line, so that the side edges of said bags are substantially aligned;

an open-mouth generally flat packaging bag of sheet material enclosing said stack with said tear strips at the bottom of said packaging bag;

means fastening together said tear strips and the adjacent portions of the side walls of said packaging bag; and openable means closing the mouth of said packaging bag, whereby on opening the mouth of said packaging bag, the bags therein can be removed one-by-one by detaching the outermost bag of the folded stack from its corresponding tear-strip.

2. The package defined in claim 1 wherein all of the bags are of plastic and the fastening means comprises a line of welding extending transversely across the enclosing packaging bag.

3. The package defined in claim 1 wherein the packaging bag has a transverse tear-strip at its open mouth for opening the latter when closed.

4. The package defined in claim 1 wherein the bags in the stack have two connected tear-strips at their open mouths with both strips extending beyond the bag bottoms, the fastening means fastens together the tear-strips remote from the bag mouths and the enclosing packaging bag has a transverse tear-strip adjacent its bottom and beyond said fastening means, whereby, on removal of the packaging bag bottom tear-strip, the tear-strips of the enclosed bags adjacent their mouths can be removed one-by-one to serve as a tie for the mouth of a removed bag.

* * * * *